US005544831A

United States Patent [19]

Van Netta

[11] Patent Number: 5,544,831

[45] Date of Patent: Aug. 13, 1996

[54] YARN CADDY

[76] Inventor: Alice H. Van Netta, 7106 Peppermill La., Memphis, Tenn. 38125

[21] Appl. No.: 359,394

[22] Filed: Dec. 20, 1994

[51] Int. Cl.[6] ..... B65H 49/30; B65H 18/28; B65H 54/46

[52] U.S. Cl. ..... 242/127; 206/388; 206/394; 206/407; 206/409; 242/129; 242/171; 242/172; 242/588.3

[58] Field of Search ..... 242/127, 570, 242/588.3, 129, 171, 172; 206/409, 407, 394, 388; 221/63, 47, 45, 46; 225/106, 90, 39, 52

[56] References Cited

U.S. PATENT DOCUMENTS

| | | | |
|---|---|---|---|
| 1,896,609 | 2/1933 | Byron et al. | 206/394 X |
| 1,974,862 | 9/1934 | Cryan | 242/171 |
| 2,020,663 | 11/1935 | Stapleford | 206/388 |
| 3,284,025 | 11/1966 | Fridolph | 206/394 X |
| 4,171,047 | 10/1979 | Doyle et al. | 225/106 X |
| 4,462,507 | 7/1984 | Margulies | 206/409 X |
| 4,526,291 | 7/1985 | Margulies | 206/409 X |
| 4,958,733 | 9/1990 | Masuda | 206/409 |
| 5,150,794 | 9/1992 | Rooks | 206/388 X |

*Primary Examiner*—Michael R. Mansen

[57] ABSTRACT

A yarn caddy including a generally tubular body for holding a sequence of skeins, the body having an open top end and an open bottom end; a rigid end cap removably sealing the bottom end of the body and with the end cap openable for allowing access within the body for loading and unloading skeins; and a lid hingeably coupled to the body for removably sealing the top end thereof and with the lid having a bore disposed therethrough for slidably receiving a strand from a skein.

1 Claim, 4 Drawing Sheets

YARN CADDY

BACKGROUND OF THE INVENTION

1. Field of the Invention

The present invention relates to a yarn caddy and more particularly pertains to holding skeins of yarn and allowing an individual continuous strand of yarn to be dispensed from one of the skeins for use with a yarn caddy.

2. Description of the Prior Art

The use of yard caddies is known in the prior art. More specifically, yard caddies heretofore devised and utilized for the purpose of holding a skein of yarn are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 266,799 to Mace discloses a skein holder or the like. U.S. Pat. No. 3,827,654 to Armstrong discloses a yarn caddy. U. S. Pat. No. 4,108, 397 to Hauck discloses a caddy for knitting and crocheting yarn. U.S. Pat. No. 4,411,363 to Walker discloses a holder for skeins of embroidery floss. U.S. Pat. No. 4,634,077 to Wilson discloses a yarn caddy.

While these devices fulfill their respective, particular objective and requirements, the aforementioned patents do not describe a yarn caddy that holds skeins in a sequential configuration for ready use and further allows ready access to an individual strand from one of the skeins.

In this respect, the yarn caddy according to the present invention substantially departs from the conventional concepts and designs of the prior art, and in doing so provides an apparatus primarily developed for the purpose of holding skeins of yarn and allowing an individual continuous strand of yarn to be dispensed from one of the skeins for use.

Therefore, it can be appreciated that there exists a continuing need for new and improved yarn caddy which can be used for holding skeins of yarn and allowing an individual continuous strand of yarn to be dispensed from one of the skeins for use. In this regard, the present invention substantially fulfills this need.

SUMMARY OF THE INVENTION

In the view of the foregoing disadvantages inherent in the known types of yard caddies now present in the prior art, the present invention provides an improved yarn caddy. As such, the general purpose of the present invention, which will be described subsequently in greater detail, is to provide a new and improved yarn caddy and method which has all the advantages of the prior art and none of the disadvantages.

To attain this, the present invention essentially comprises, in combination, a rigid upstanding transparent plastic body. The body includes a containment tube for holding skeins of yarn therein in a sequenced configuration. The containment tube has a central axis defined therethrough, an open top end, an open bottom end, and a plurality of threads extended radially outwards therefrom at a location adjacent to the bottom end. The body also includes a tubular mouth in axial alignment with the containment tube for receiving a strand of yarn from one of the skeins. The mouth has an open lower end with an annular flange extending radially outwards therefrom and interconnected with the top end of the containment tube and an open upper end with an annular lip projected radially outwards therefrom. The body has an axial length 2¾ times the diametric extent of the containment tube.

A rigid transparent plastic end cap is provided. The end cap has a horizontal circular planar lower end wall, a tubular lower side wall extended upwards from the periphery of the lower end wall, and a plurality of inwardly projected radial threads disposed on the lower side wall. The end cap is threadedly securable to the bottom end of the body in one orientation for preventing access therein and openable in another orientation for allowing access therein for loading and unloading skeins of yarn.

A generally flexible transparent plastic lid is included and has a horizontal circular planar upper end wall with a circular bore disposed centrally therethrough and with the bore having a diameter sized for slidably receiving a strand of yarn therein. A linear slit extends radially outwards from the bore and has a length at least that of the bore diameter. Additionally, a tubular upper side wall extends downwards from the periphery of the upper end wall and is terminated at a peripheral edge. The upper side wall of the lid has an interior surface, an exterior surface, a tongue extended outwards from the exterior surface at a location adjacent to peripheral edge for allowing a user a firm grip of the lid, and an annular recess formed on the interior surface at a location adjacent to the upper end wall and with the recess having a size for snapidly and snugly receiving the lip on the mouth of the body.

Lastly, a flexible transparent plastic hinge couples the lid to the mouth of the body. The hinge has an annular plastic base extended in slidable contact about the mouth below the lip and a band with a lower end integral with the base and an upper end integral with the upper side wall of the lid near the peripheral edge thereof and at a location diametrically opposed to the tongue. The hinge allows the lid to be placed over and removably snapidly coupled to the mouth of the body. The lid is further decoupleable from the body for allowing access therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved yarn caddy which has all the advantages of the prior art yarn caddies and none of the disadvantages.

It is another object of the present invention to provide a new and improved yarn caddy which may be easily and efficiently manufactured and marketed.

It is a further object of the present invention to provide a new and improved yarn caddy which is of durable and reliable construction.

An even further object of the present invention is to provide a new and improved yarn caddy which is susceptible of a low cost of manufacture with regard to both materials and labor, and which accordingly is then susceptible of low prices of sale to the consuming public, thereby making such a yarn caddy economically available to the buying public.

Still yet another object of the present invention is to provide a new and improved yarn caddy which provides in the apparatuses and methods of the prior art some of the advantages thereof, while simultaneously overcoming some of the disadvantages normally associated therewith.

Even still another object of the present invention is to provide a new and improved yarn caddy comprising a generally tubular body for holding a sequence of skeins and with the body having an open top end and an open bottom end; a rigid end cap removably sealing the bottom end of the body and with the end cap openable for allowing access within the body for loading and unloading skeins; a lid hingeably coupled to the body for removably sealing the top end thereof and with the lid having a bore disposed therethrough for slidably receiving a strand from a skein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

With reference now to the drawings, and in particular, to FIGS. 2 through 6 thereof, the preferred embodiment of the new and improved yarn caddy embodying the principles and concepts of the present invention and generally designated by the reference number 10 will be described.

The present invention is comprised of a plurality of components in their broadest context, such components include a body, end cap, and hinged lid. Such components are individually configured and correlated with respect to each other to provide the intended function of holding skeins 11 of yarn and allowing an individual a continuous strand of yarn to be dispensed from one of the skeins for use.

Figure 1:
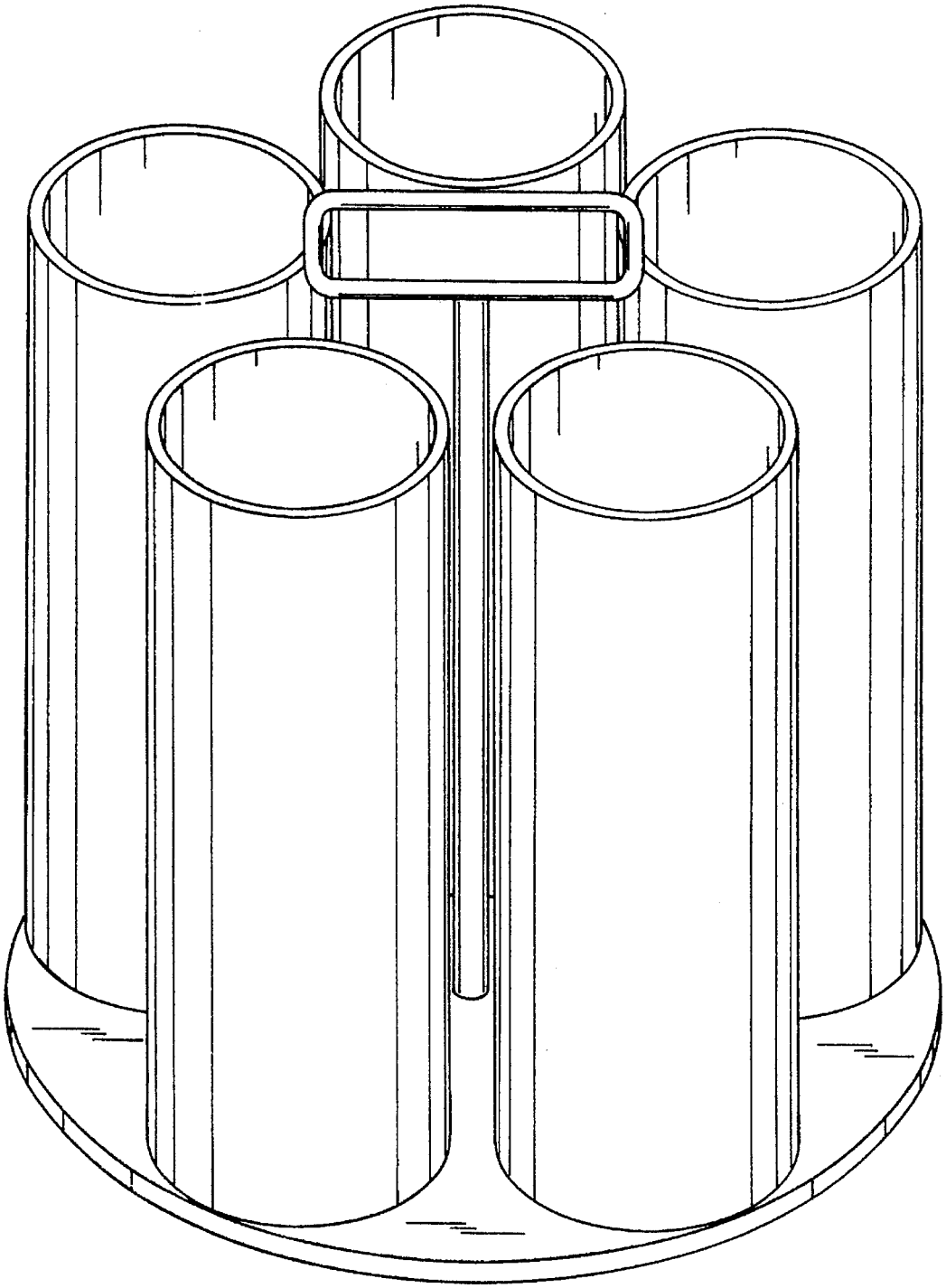
PRIOR ART FIG. 1
FIG. 1 is a perspective view of a prior art yarn caddy.
Figure 2:
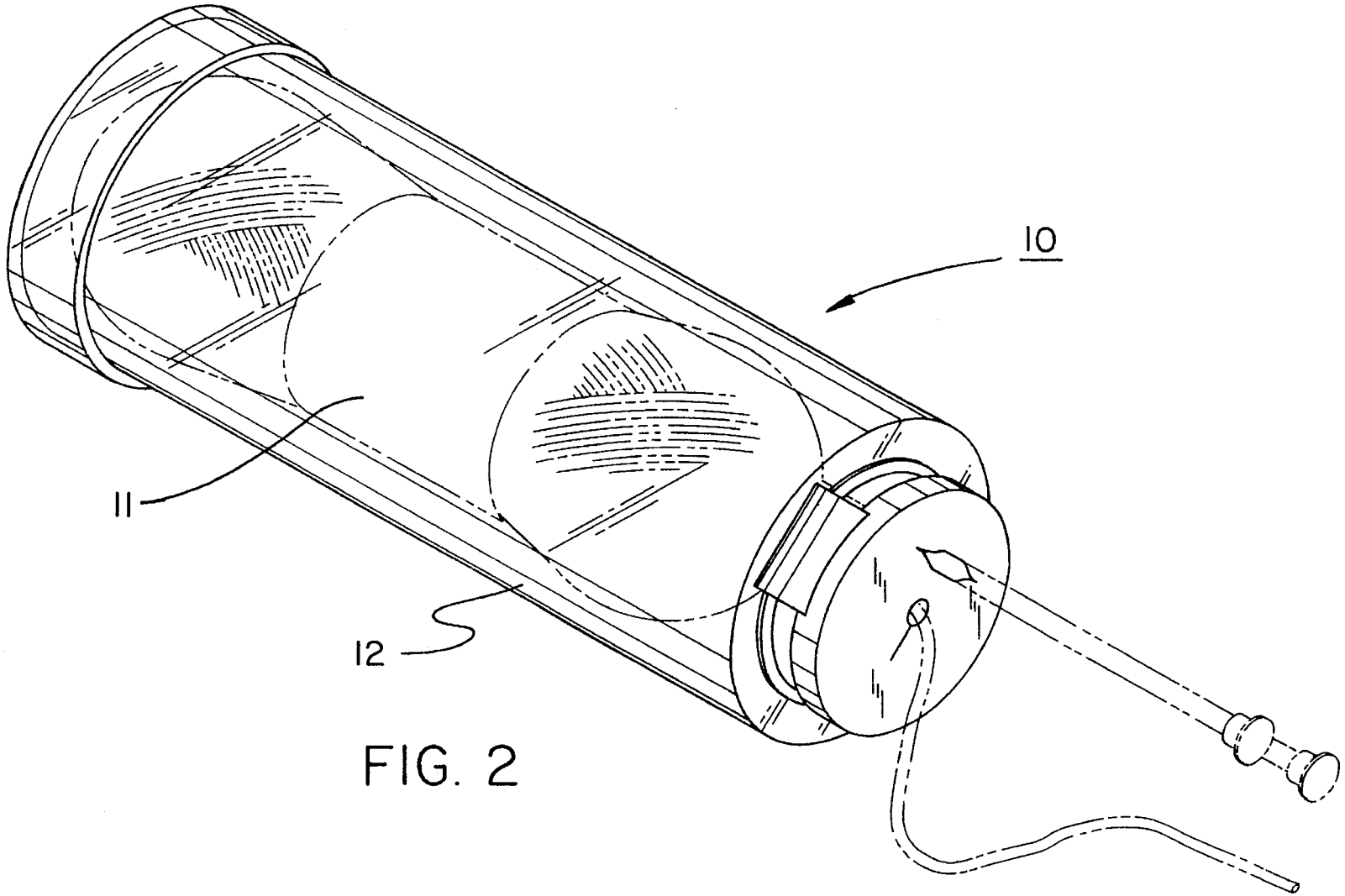
FIG. 2 is a perspective view of the preferred embodiment constructed in accordance with the principles of the present invention loaded with skeins of yarn for use.
Figure 3:
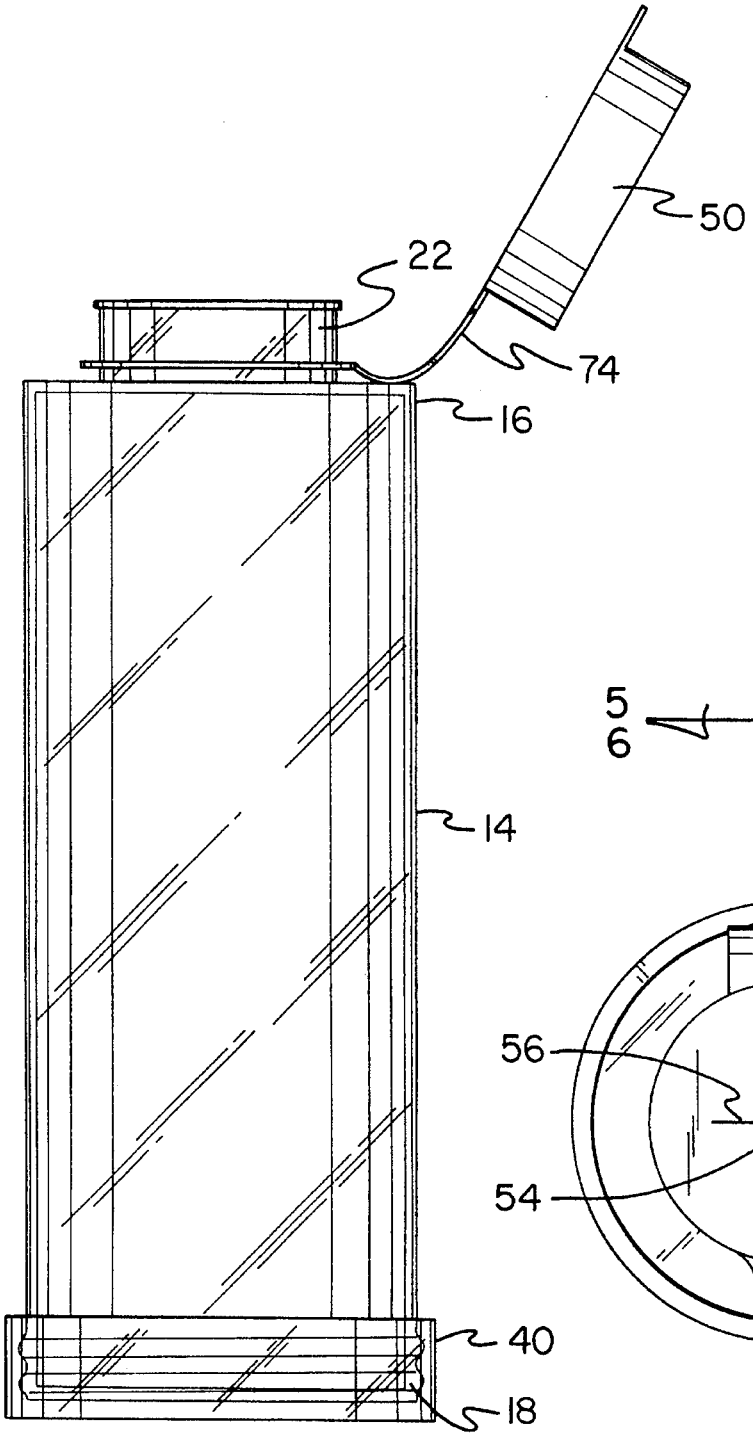
FIG. 3 is a side elevational view of the preferred embodiment of the present invention.
Figure 5:
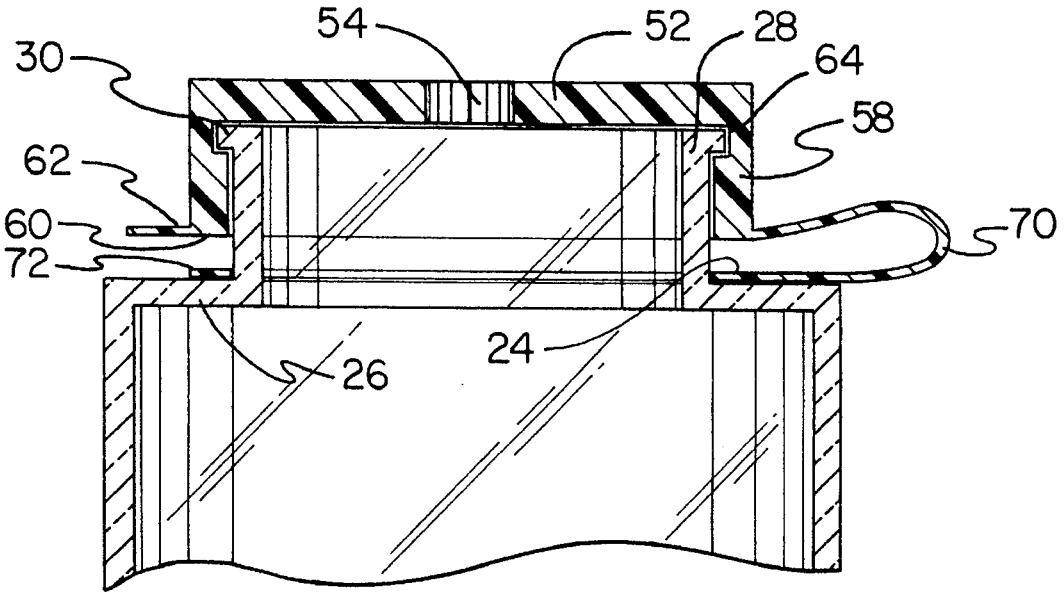
FIG. 5 is a cross-sectional view of the present invention taken along the line 5—5 of FIG. 4.

Specifically, the present invention includes a body 12. The body is formed of a rigid transparent plastic material. The body includes a linear containment tube 14 for holding skeins of yarn therein in a sequenced configuration as shown in FIG. 2. The containment tube has a central axis defined therethrough, and opened top end 16 and an opened bottom end 18. The containment tube also includes a plurality of threads 20 radially extended outwards therefrom at a location adjacent to the bottom end as illustrated in FIG. 3. The body further includes a tubular mouth 22. The mouth is positioned in axial alignment with the containment tube and is used for receiving a strand of yarn from one of the skeins. Referring to FIG. 5, the mouth has an open lower end 24 with an annular flange 26 extended radially outwards therefrom. This flange is interconnected with the top end 16 of the containment tube to essentially create a top wall. The mouth also has an open upper end 28 with an annular lip 30 projected radially outwards therefrom. The overall axial length of the body in the preferred embodiment is 11 inches. The diametric extent of the containment tube is about 4 inches. Thus, the body, has an axial length about 2¾ times the diametric extent of the containment tube.

Figure 6:
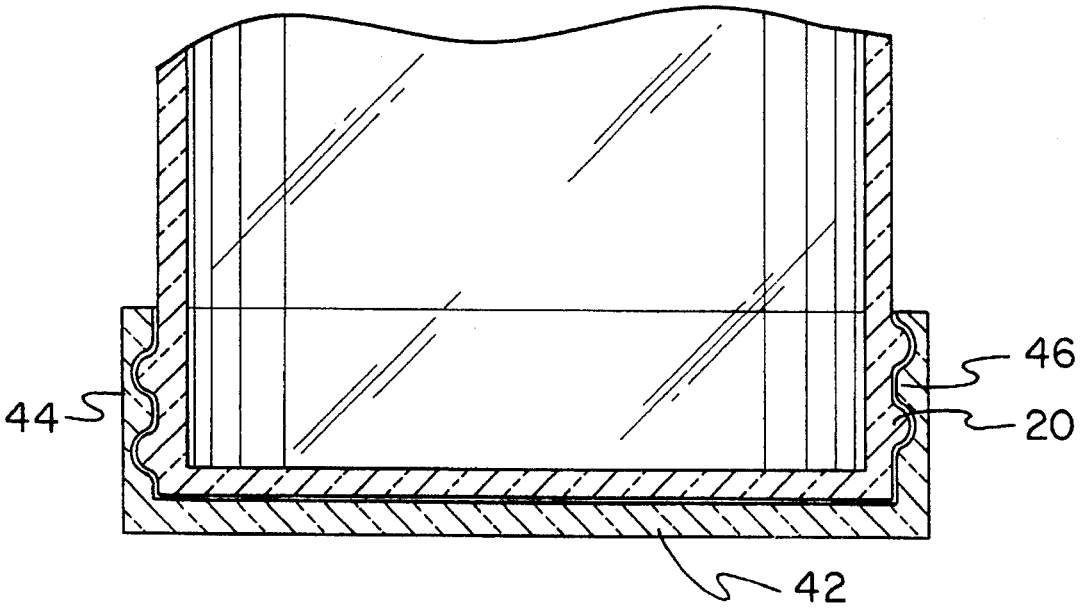
FIG. 6 is a cross-sectional view of the present invention taken along the line 6—6 of FIG. 4.

An end cap 40 is also provided as shown in FIGS. 3 and 6. The end cap is formed of a rigid transparent plastic material. The end cap has a circular planar lower end wall 42 and a tubular lower side wall 44 extended upwards from the periphery of the lower end wall. A plurality of inwardly projected radial threads 46 are disposed on the lower side wall. The end cap is threadedly securable to the bottom end 18 of the body in one orientation for preventing access therein. Furthermore, the end cap is openable in another orientation for allowing access therein for loading and unloading skeins of yarn.

Figure 4:
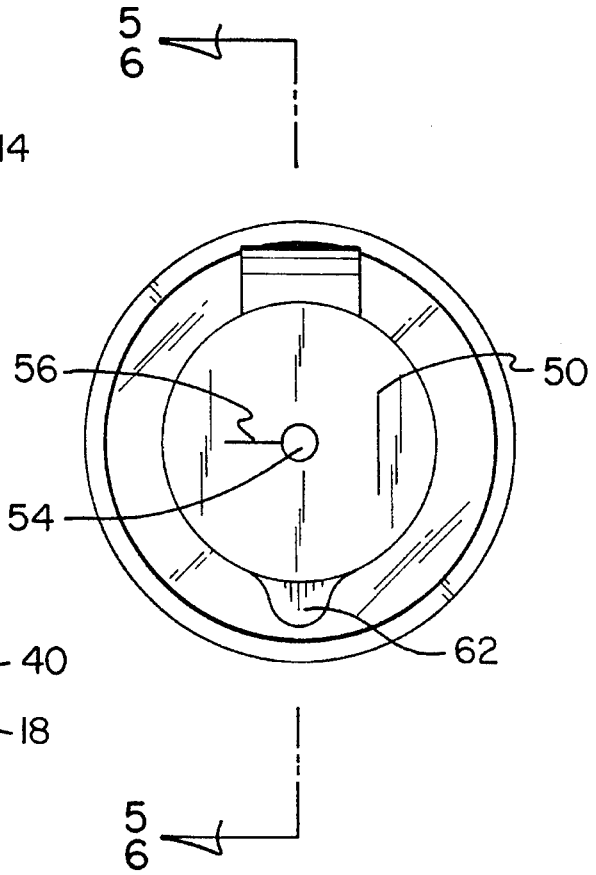
FIG. 4 is a plan view of the preferred embodiment of the present invention.

The present invention also includes a lid 50. The lid is generally flexible in structure. It is formed of a transparent plastic material. The lid has a horizontal circular planar upper end wall 52 with a circular bore 54 centrally disposed therethrough as best illustrated in FIG. 5. The bore has a diameter sized for slidably receiving a strand of yarn therein from one of the skeins within the body. The bore allows yarn to payed out from the body for use. The lid also includes a linear slit 56 as shown in FIG. 4. The slit is extended radially outwards from the bore. The slit has a length at least equal to that of the bore diameter to ensure that a strand of yarn from the body can be held snugly therein in stowed position. The lid also includes a tubular upper side wall 58. as shown in FIG. 5. The side wall is extended downwards from the periphery of the upper end wall and terminated at a peripheral edge 60. The upper side wall has an interior surface and an exterior surface. A tongue 62 is extended outwards from the exterior surface at a location adjacent to the peripheral edge 60. The tongue allows a user a firm grip of the lid. Lastly, an annular recess 64 is formed on the interior surface of the lid at a location adjacent to the upper end wall 52 thereof. The recess is sized for snapidly, snugly, and removably receiving the lip 30 on the mouth of the body.

A hinge 70 couples the lid 50 to the mouth 22 of the body. The hinge is flexible in structure and formed of a transparent plastic material. The hinge has an annular plastic base 72 extended in slidable contact about the mouth at a location below the lip 30. The base has a diameter that precludes it from sliding over the lip of the mouth when secured thereto. The lid also includes a band 74 with a lower end integral with the base 72 and an upper end integral with the upper side wall 58 of the lid at a location near the peripheral edge 60. Furthermore, the upper end of the band is positioned at a location diametrically opposed to the tongue 62. The hinge allows the lid to be placed over and removably snapidly coupled to the mouth of the body. Furthermore, the hinge allows the lid to be decoupled from the body for allowing access therein.

The present invention is a container that holds skeins of yarn so that they can be used easily without becoming entangled with other yarns. The present invention consists of a body, a bottom end cap, and a top lid. All three pieces are made with plastic. The end cap is threaded such that it can be screwed on and off. The top lid is easily pressed onto the body to secure it into place. A bore in the lid enables yarn from one of the skeins to slide through freely when in use, and a slit on one side of the bore holds the end of the yarn when it is not in use and prevents it from retracting inside the body. The present invention can be adapted for use with embroidery floss and the like.

To operate the present invention, unscrew the end cap and insert several skeins of yarn in the body such that they are sequentially stacked as shown in FIG. 2. Thread a loose end of one of the skeins of yarn through the bore of the lid. Now, screw the end cap back into place, and secure the lid over the mouth. The strand of yarn is now positioned for use. The end of the strand of yarn can be secured in the slit if it is not going to be used immediately. The present invention prevents yarn from becoming tangled as it is being pulled from a skein and when using more than one color of yarn in a piece of work. The clear plastic body makes the yarn colors visible without having to open the container.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A yarn caddy for holding skeins of yarn and allowing an individual continuous strand of yarn to be dispensed from one of the skeins for use comprising, in combination:

a rigid upstanding transparent plastic body including a containment tube for holding skeins of yard therein in a sequenced configuration, the containment tube having a central axis defined therethrough, an open top end, an open bottom end, and a plurality of threads extended radially outwards therefrom at a location adjacent to the bottom end, the body further including a tubular mouth in axial alignment with the containment tube for receiving a strand of yarn from one of the skeins, the mouth having an open lower end with an annular flange extending radially outwards therefrom and interconnected with the top end of the containment tube and an open upper end with an annular lip projected radially outwards therefrom, the body additionally having an axial length 2¾ times the diametric extent of the containment tube;

a rigid transparent plastic end cap having a horizontal circular planar lower end wall, a tubular lower side wall extended upwards from the periphery of the lower end wall, and a plurality of inwardly projected radial threads disposed on the lower side wall, the end cap threadedly securable to the bottom end of the body in one orientation for preventing access therein and openable in another orientation for allowing access therein for loading and unloading skeins of yarn;

a generally flexible transparent plastic lid having a horizontal circular planar upper end wall with a circular bore disposed centrally therethrough and with the bore having a diameter sized for slidably receiving a strand of yarn therein, a linear slit extending radially outwards from the bore and having a length at least that of the bore diameter, a tubular upper side wall extended downwards from the periphery of the upper end wall and terminated at a peripheral edge, the upper side wall having an interior surface, an exterior surface, a tongue extended outwards from the exterior surface at a location adjacent to peripheral edge for allowing a user a firm grip of the lid, and an annular recess formed on the interior surface at a location adjacent to the upper end wall and with the recess having a size for snapidly and snugly receiving the lip on the mouth of the body; and a flexible transparent plastic hinge coupling the lid to the mouth of the body, the hinge having an annular plastic base extended in slidable contact about the mouth below the lip and a band with a lower end integral with the base and an upper end integral with the upper side wall of the lid near the peripheral edge thereof and at a location diametrically opposed to the tongue, the hinge allowing the lid to be placed over and removably snapidly coupled to the mouth of the body and further allowing the lid to be decoupled from the body for allowing access therein.

* * * * *